US008025099B2

(12) United States Patent
Mesher

(10) Patent No.: US 8,025,099 B2
(45) Date of Patent: Sep. 27, 2011

(54) WATER TRANSFER SYSTEM

(75) Inventor: Shaun T. Mesher, Calgary (CA)

(73) Assignee: GasFrac Energy Services Inc., Calgary (CA)

( * ) Notice: Subject to any disclaimer, the term of this patent is extended or adjusted under 35 U.S.C. 154(b) by 178 days.

(21) Appl. No.: 12/325,968

(22) Filed: Dec. 1, 2008

(65) Prior Publication Data

US 2010/0132950 A1 Jun. 3, 2010

(51) Int. Cl.

| | |
|---|---|
| ***E21B 43/25*** | (2006.01) |
| ***E21B 43/26*** | (2006.01) |
| *C09K 8/64* | (2006.01) |
| *C09K 8/82* | (2006.01) |

(52) U.S. Cl. ..... 166/263; 166/305.1; 166/308.4; 507/261; 507/266; 507/267; 507/268

(58) Field of Classification Search ..... None
See application file for complete search history.

(56) References Cited

U.S. PATENT DOCUMENTS

| | | | | | |
|---|---|---|---|---|---|
| 3,016,351 | A | * | 1/1962 | Hessel et al. | 166/275 |
| 3,220,473 | A | * | 11/1965 | Holm | 166/400 |
| 3,288,212 | A | | 11/1966 | O'Brien | |
| 3,444,930 | A | | 5/1969 | Williams | |
| 3,467,194 | A | * | 9/1969 | Jones et al. | 166/305.1 |
| 3,520,366 | A | | 7/1970 | Jones | |
| 3,759,325 | A | | 9/1973 | Gogarty | |
| 3,765,488 | A | * | 10/1973 | Pence, Jr. | 166/308.6 |
| 3,818,993 | A | | 6/1974 | Gogarty | |
| 3,846,310 | A | | 11/1974 | Blackwell | |
| 3,902,557 | A | * | 9/1975 | Shaughnessy et al. | 166/295 |
| 3,920,073 | A | * | 11/1975 | Holm | 166/270.1 |
| 3,954,626 | A | | 5/1976 | Greminger | |
| 4,017,405 | A | * | 4/1977 | Holm | 507/254 |
| RE32,302 | E | * | 12/1986 | Almond et al. | 166/308.6 |
| 2005/0189112 | A1 | * | 9/2005 | Taylor et al. | 166/278 |

FOREIGN PATENT DOCUMENTS

| | | | |
|---|---|---|---|
| CA | 2557459 | A1 | 9/2005 |
| CA | 2509780 | A1 | 10/2006 |

* cited by examiner

*Primary Examiner* — George Suchfield
(74) *Attorney, Agent, or Firm* — Christensen O'Connor Johnson Kindness PLLC

(57) ABSTRACT

A method of treating a hydrocarbon reservoir that is penetrated by a well is disclosed, the method comprising injecting into the well a water transfer system comprising liquefied petroleum gas (LPG) and an alcohol that is at least partially water and liquefied petroleum gas soluble. Further, a method of treating a hydrocarbon reservoir is disclosed, the method comprising introducing into the hydrocarbon reservoir a combination of LPG and a solvent system that is at least partially liquefied petroleum gas and water soluble.

35 Claims, 2 Drawing Sheets

WATER TRANSFER SYSTEM

TECHNICAL FIELD

This document relates to solvent systems used to remove water from hydrocarbon reservoirs, and more specifically water transfer systems and methods.

BACKGROUND

Many known hydrocarbon reservoir treatments incorporate the use of water or oil-based treatments in order increase production from a production well. One such method is known as secondary recovery, in which an external fluid such as water or gas is injected into a reservoir through injection wells located in earth that are in fluid communication with the production well. The purpose of secondary recovery is to maintain reservoir pressure and to displace hydrocarbons toward the production wellbore in the production well. U.S. Pat. No. 3,520,366 is one example of such a method. Unfortunately, the secondary recovery stage reaches its limit when the injected fluid (water or gas) begins to be produced in considerable amounts from the production well, making production no longer economical.

Treatments such as secondary recovery tend to contribute vast amounts of damaging water to a formation, which eventually contaminate the formation to the point where it is not economically feasible to continue production. Many wells have been shut down due to such water or other damage.

Thus, there exists a need for repairing a formation from fluid damage.

SUMMARY

A method of treating a hydrocarbon reservoir that is penetrated by a well is disclosed, the method comprising injecting into the well a water transfer system comprising liquefied petroleum gas (LPG) and an alcohol that is at least partially water and liquefied petroleum gas soluble.

A method of treating a hydrocarbon reservoir is disclosed, the method comprising introducing into the hydrocarbon reservoir a combination of LPG and a solvent system that is at least partially liquefied petroleum gas and water soluble.

A water transfer system for removing water from a damaged hydrocarbon reservoir is also disclosed, comprising LPG and an alcohol that is at least partially water and liquefied petroleum gas soluble.

A method of treating a hydrocarbon reservoir that is penetrated by a well is also disclosed, the hydrocarbon reservoir comprising water damage. A water transfer system comprising hydrocarbon fluid and an alcohol that is at least partially water and hydrocarbon fluid soluble is injected into the well. The water transfer system acts to remove water damage from the hydrocarbon reservoir.

This solvent system may be used to remediate and/or restore lost permeability in oil and gas bearing formations due to water blockage and irreducible water saturation. This system may also be used to clean up water-fractured wells.

These and other aspects of the system and method are set out in the claims, which are incorporated here by reference.

BRIEF DESCRIPTION OF THE FIGURES

Embodiments will now be described with reference to the figures, in which like reference characters denote like elements, by way of example, and in which.

DETAILED DESCRIPTION

Immaterial modifications may be made to the embodiments described here without departing from what is covered by the claims.

The solvent system disclosed herein may be used to remediate and/or restore lost permeability in oil and gas bearing formations due to water blockage and irreducible water saturation. This solvent system may be used in conjunction with LPG, for example ethane, propane, butane or pentane or a mixture thereof. In some embodiments, LPG comprises predominantly propane, butane, or a combination of propane and butane. After treatment, production from the hydrocarbon reservoir is improved.

Figure 1:
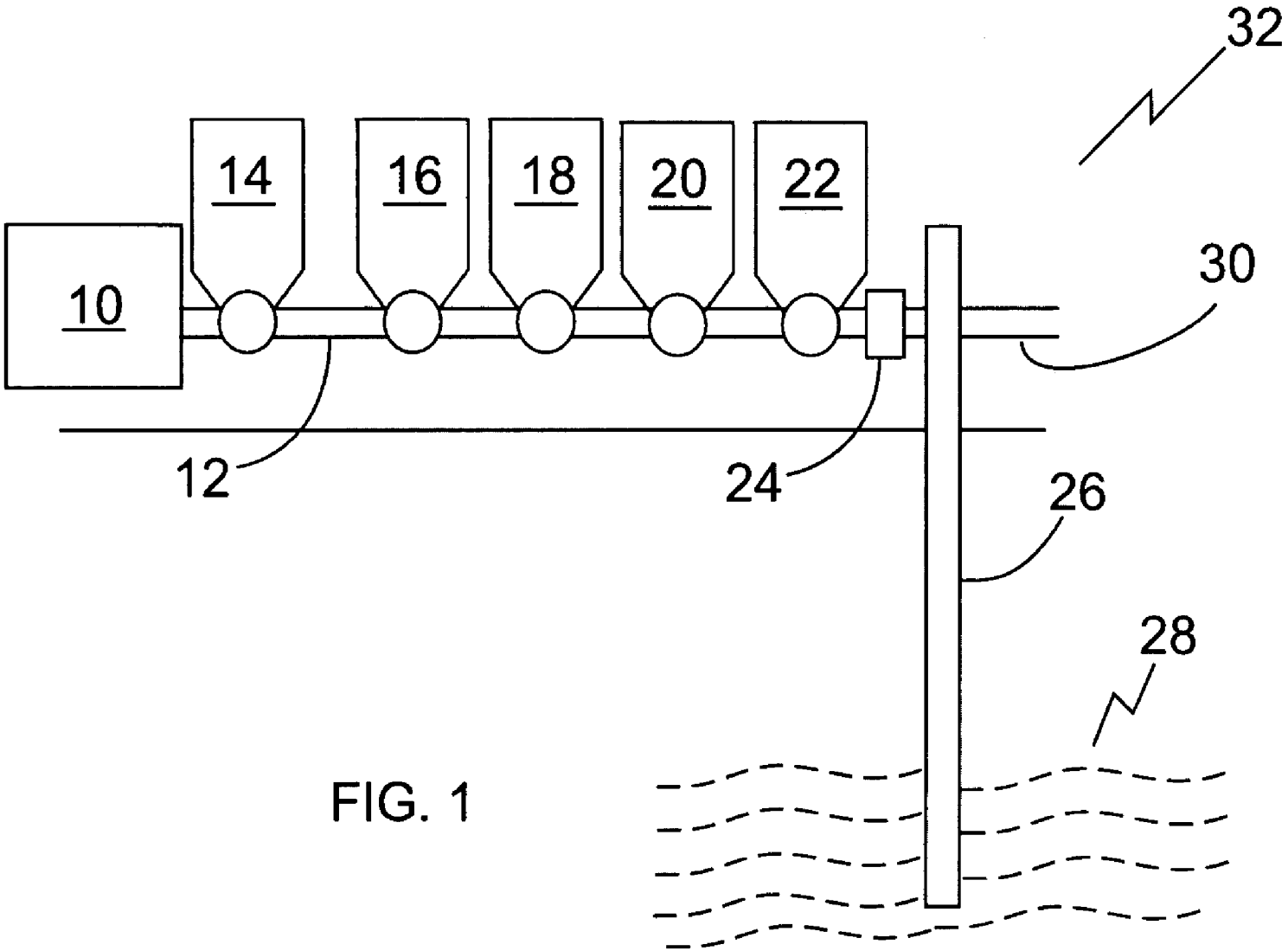
FIG. 1 is a schematic illustrating a system for carrying out a method of treating a hydrocarbon reservoir.

Referring to FIG. 1, a system 32 that may be used to treat a hydrocarbon reservoir is illustrated. System 32 may comprise an LPG source 10 at a well site. LPG source 10 comprises LPG, although in some embodiments LPG source 10 comprises other hydrocarbons as well. LPG source 10 is connected via line 12 to supply the water transfer system through well 26 to a hydrocarbon reservoir 28. Well 26 may be a production well. A pump 24 may be provided to provide pressure to pump the water transfer system downhole.

Figure 2:
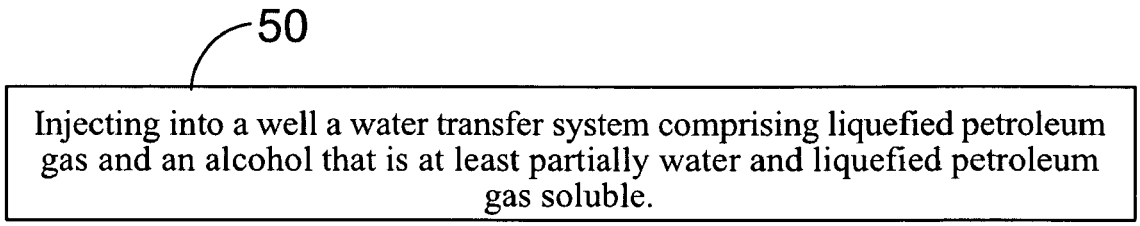
FIG. 2 is a flow schematic illustrating a method of treating a hydrocarbon reservoir that is penetrated by a well.

Referring to FIG. 2, a method of treating a hydrocarbon reservoir that is penetrated by a well is illustrated. Referring to FIG. 1, in a first stage 50 (shown in FIG. 2), a water transfer system comprising liquefied petroleum gas and an alcohol that is at least partially water and liquefied petroleum gas soluble is injected as one into well 26. The liquefied petroleum gas may be present in an amount of between 40 and 60% by volume of the water transfer system. As is illustrated in the exemplary embodiment, this may be carried out as follows. LPG source 10 supplies LPG fluid to line 12 in a water transfer stream. Along line 12, a desired ratio of alcohol is added to the water transfer stream via alcohol source 14. The supply of alcohol, or any other component added to the water transfer stream, may be tailored to fit the reservoir 28 being treated. The water transfer system is then supplied down well 26 and into the hydrocarbon reservoir 28.

In some embodiments, the hydrocarbon reservoir 28 is a damaged reservoir, for example a water-damaged reservoir. The damaged reservoir may comprise a reservoir that was previously treated with a water-based fracturing fluid comprising CO2. The CO2 may have been polymerized in a poly-CO2 water based frac.

In some embodiments, the alcohol is present in an amount of 1-60% by volume of the water transfer system. In further embodiments, the alcohol is present in an amount of 1-30% by volume of the water transfer system. Table 1 illustrates in trial number 1 an exemplary system that contains alcohol, in the form of isopropyl alcohol and methanol. In some embodiments, the alcohol has between 1 and 8 carbon atoms, while in further embodiments, the alcohol has between 1 and 4 carbon atoms. In some embodiments, the alcohol is not a surfactant.

In some embodiments, the water transfer system further comprises an ester that is at least partially water and liquefied petroleum gas soluble. Referring to FIG. 1, ester may be added to the water transfer stream via ester source 16. The ester may be present in an amount of at least 1% by volume of the water transfer system. Further, the ester may be present in an amount of at most 30% by volume of the water transfer system. Further, the ester may be present in an amount of at most 20% by volume of the water transfer system. Table 2 illustrates in trial number 6 the use of an ester, as provided as part of SYNSOL M™ solvent available from Synoil Fluids, Calgary, Alberta, Canada. SYNSOL M™ solvent may contain for example, between 5 and 50% ester by volume of the SYNSOL M™ solvent. In some embodiments, the ester has between 1 and 8 carbon atoms, while in further embodiments, the ester has between 3 and 6 carbon atoms. The alcohol and the ester may be provided as part of the same molecule. An exemplary ester includes methyl ethyl ester.

In some embodiments, the water transfer system further comprises an ether that is at least partially water and liquefied petroleum gas soluble. Referring to FIG. 1, the ether may be added to the water transfer stream via ether source 18. The ether may be present in an amount of at least 1% by volume of the water transfer system. In further embodiments, the ether is present in an amount of at most 30% by volume of the water transfer system. In further embodiments, the ether is present in an amount of at most 20% by volume of the water transfer system. Table 2 illustrates in trial number 6 the use of an ether as provided in SYNSOL M™ solvent. SYNSOL M™ solvent may contain for example, between 5 and 50% ether by volume of the SYNSOL M™ solvent for example a cyclic ether such as tetrahydrofuran. The ether may have between 1 and 8 carbon atoms, and further the ether may have between 3 and 6 carbon atoms. The alcohol and the ether may be provided as part of the same molecule. Exemplary ethers include dimethyl ether and glycol ethers.

In some embodiments, the water transfer system further comprises a ketone that is at least partially water and liquefied petroleum gas soluble. Referring to FIG. 1, the ketone may be added to the water transfer stream via ketone source 20. The ketone may be present in an amount of at least 1% by volume of the water transfer system. In some embodiments, the ketone is present in an amount of at most 30% by volume of the water transfer system. In further embodiments, the ketone is present in an amount of at most 15% by volume of the water transfer system. Table 1 illustrates in trial number 2 an exemplary system that contains methyl ethyl ketone. The ketone may have between 1 and 8 carbon atoms. In some embodiments, the ketone has between 3 and 6 carbon atoms. The alcohol and the ketone may part of the same molecule.

In some embodiments, the water transfer system further comprises a demulsifier. The demulsifier may act to eliminate or reduce emulsions with water, and may tend to make the LPG separate slower from the water transfer system. This reduces the chances of water and solvent being left in the formation, as the LPG is allowed to remain associated with the aqueous phase longer in order to lift it from the reservoir 28. Referring to FIG. 1, the demulsifier may be added to the water transfer stream via demulsifier source 22. The demulsifier can be any commercially available demulsifier, for example ones made by Alken, Baker Petrolite, Clariant Oil Services, Nalco, Uniqema, and M-I SWACO Production Technologies. The demulsifiers may be, for example, acid catalysed phenol-formaldehyde resins, base catalysed phenol-formaldehyde resins, polyamines, di-epoxides, and/or polyols.

The demulsifier may be present in an amount of at least 1% by volume of the water transfer system. In some embodiments, the demulsifier may be present in an amount of at least 3% by volume of the water transfer system. Table 3 illustrates in trial number 16 the use of a demulsifier.

Figure 3:
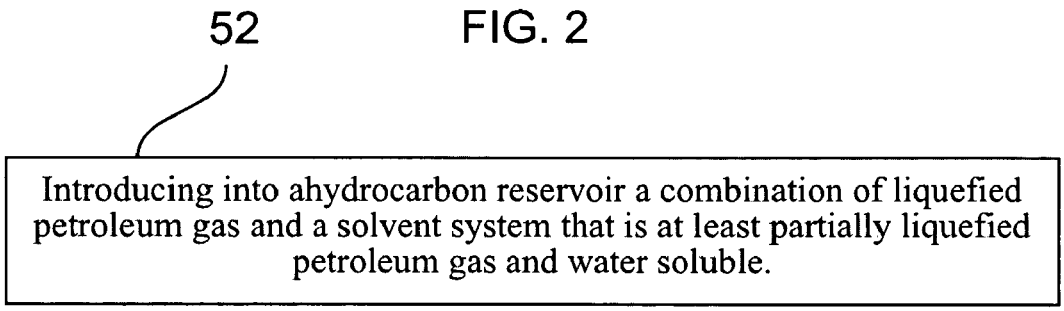
FIG. 3 is a flow schematic illustrating a method of treating a hydrocarbon reservoir.
Figure 4:
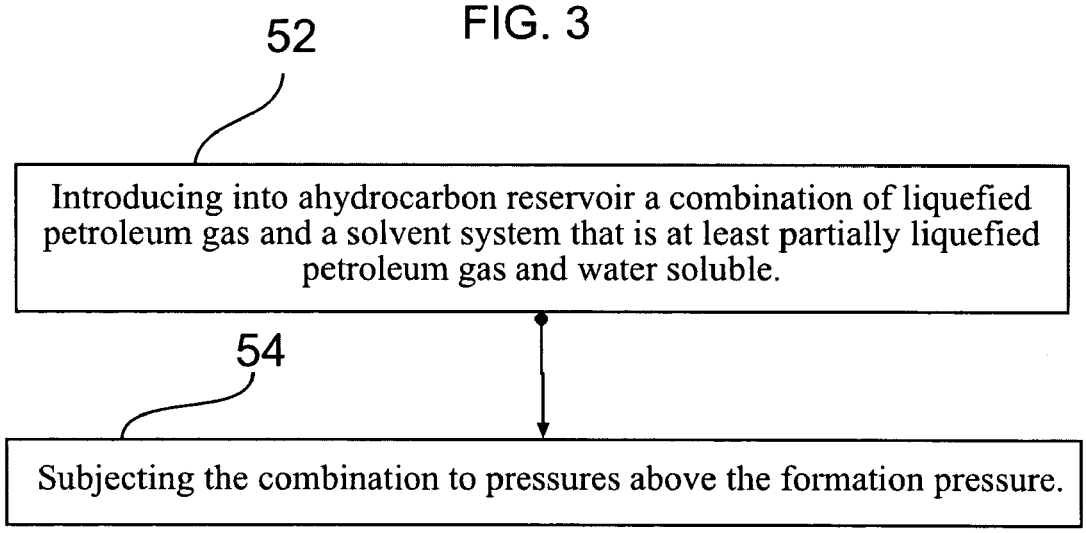
FIG. 4 is a flow schematic illustrating a further method of treating a hydrocarbon reservoir.

Referring to FIG. 3, a method of treating a hydrocarbon reservoir is illustrated. Referring to FIG. 1, in a first stage 52 (shown in FIG. 3) a combination of liquefied petroleum gas and a solvent system that is at least partially liquefied petroleum gas and water soluble is introduced into the hydrocarbon reservoir 28. The solvent system may be the non-LPG components of the water transfer system disclosed above, although other components not mentioned may be present. In a further stage 54 (shown in FIG. 4), the combination is subjected to pressures above the formation pressure. In some embodiments, the method involves injecting the combination into the hydrocarbon reservoir 28, and then removing it after a sufficient amount of time through line 30. The treating method may be for example a clean-up treatment of a formation. The water transfer system may not be gelled. As disclosed above, the solvent system may comprise an alcohol. Further as disclosed above, the solvent system may comprise an ether. Further as disclosed above, the solvent system may comprise an ester. Further as disclosed above, the solvent system may comprise a ketone. Further as disclosed above, the solvent system may comprise a demulsifier. In some embodiments, the solvent system is a mutual solvent system. Examples of such systems are illustrated in Table 2 in trials 6-8, where SYNSOL M™ solvent is used in the solvent system. The combination may be non-aqueous. The non LPG solvent components, for example alcohol, act to absorb the water and may reduce the surface tension of the entire liquid. The reduced surface tension thus reduces the amount of pressure required to displace the liquid from the pore spaces.

In some embodiments, any combination of the alcohol, ester, ether, and ketone moieties may be provided as part of the same molecule. For example a ketone and an ester may be provided on the same molecule.

In some embodiments, the non LPG components of the water transfer system are volatile. Less volatile, heavier materials may hold back water, instead of making it more inclined to flow from the formation. In some embodiments, all of the non-LPG components may be provided as C1-C4 molecules. These components may be soluble in LPG and water. In other embodiments, these components reduce the surface tension of water. The alcohols, ethers, ketones and esters chosen may have high volatility with a corresponding low boiling point.

Exemplary sources 14, 16, 18, 20, and 22 may be provided as required to add any other components required to the LPG, in order to form a suitable water transfer system for treating reservoir 28. In some embodiments, the entirety of water transfer source 10 may be provided in a single source, and may simply be supplied down well 26 to absorb and remove water from the formation 28. In other embodiments, the non-LPG components may be provided in a source separate from the LPG source 10, and blended with the LPG on site to create the water transfer system.

The water transfer system allows the alcohol, and any other components present to contact the formation water and then expel the LPG. In some embodiments this is improved by providing the water transfer system as a solution. This allows the system to more effectively contact and transfer water from the formation. The use of at least one of the ether, ester, and ketone, in addition to the alcohol, may assist the LPG to stay in solution with the water transfer system prior to coming into contact with water.

Tables 1-3 illustrate exemplary trials using different combinations as the water transfer system. The combinations are mixed with water, and the resulting size of the aqueous containing phase is indicated. The relative size of this layer gives an indication of the effectiveness of the separation. For example the combination of trial 1 achieved a better separation then the combination of trial 3, as the LPG phase in trial 3 contained part of the original water transfer system components, while the LPG phase in trial 1 did not. Trials 1-15 compared the separation with distilled water. Trial 16, however, compared the separation with flowback water from a well. In this trial, a 3 mL layer of semi-solids appeared between the two phases. In trial 15, water was added drop by drop to the water transfer system until the pentane separated, which took 3.2 mL to accomplish. For trial 14, demulsifier was added drop by drop as the water and combination were mixed until the separation rate slowed considerably.

TABLE 1

Exemplary water transfer systems

| | Trial no. | | | | |
|---|---|---|---|---|---|
| | 1 | 2 | 3 | 4 | 5 |
| Distilled Water (mL) | 50 | 50 | 50 | 50 | 50 |
| Flowback Water (mL) | — | — | — | — | — |
| Pentane (mL) | 25 | 25 | 25 | 25 | 25 |
| IPA (mL) | 12.5 | 12.5 | 12.5 | 12.5 | 12.5 |
| Methanol (mL) | 12.5 | 12.5 | 12.5 | — | — |
| Acetone (mL) | — | — | — | 12.5 | 12.5 |
| SYNSOL M ™ solvent (mL) | — | — | — | — | — |
| MEK (mL) | — | 15 | 15 | — | 15 |
| Ethanol (mL) | — | — | — | — | — |
| Hexanol (mL) | — | — | — | — | — |
| Demulsifier (mL) | — | — | 2 | — | — |
| Total (mL) | 100 | 115 | 117 | 100 | 115 |
| Aq phase (mL) | 75 | 85 | 85 | 75 | 81 |
| Non-aq phase minus pentane (mL) | 0 | 5 | 7 | 0 | 9 |

TABLE 2

Further exemplary water transfer systems

| | Trial no. | | | | |
|---|---|---|---|---|---|
| | 6 | 7 | 8 | 9 | 10 |
| Distilled Water (mL) | 50 | 50 | 50 | 50 | 50 |
| Flowback Water (mL) | — | — | — | — | — |
| Pentane (mL) | 25 | 25 | 25 | 25 | 25 |
| IPA (mL) | — | — | 12.5 | 25 | 25 |
| Methanol (mL) | — | — | — | — | — |
| Acetone (mL) | — | — | — | — | — |
| SYNSOL M ™ solvent (mL) | 25 | 25 | 12.5 | — | — |
| MEK (mL) | — | — | — | — | — |
| Ethanol (mL) | — | — | — | — | — |
| Hexanol (mL) | — | 1 | — | — | 1 |
| Demulsifier (mL) | — | — | — | — | — |
| Total (mL) | 100 | 101 | 100 | 100 | 101 |
| Aq phase (mL) | 66 | 65 | 71 | 66 | 65 |
| Non-aq phase minus pentane (mL) | 9 | 11 | 4 | 9 | 11 |

TABLE 3

Further exemplary water transfer systems

| | Trial no. | | | | | |
|---|---|---|---|---|---|---|
| | 11 | 12 | 13 | 14 | 15 | 16 |
| Distilled Water (mL) | 50 | 33.33 | 50 | 50 | 3.2 | — |
| Flowback Water (mL) | — | — | — | — | — | 50 |
| Pentane (mL) | 25 | 33.33 | 25 | 25 | 25 | 25 |
| IPA (mL) | 7.5 | 16.67 | 7.5 | 7.5 | 7.5 | 7.5 |
| Methanol (mL) | 7.5 | 16.67 | 5 | 5 | 5 | 5 |
| Acetone (mL) | — | — | 5 | 5 | 5 | 5 |
| SYNSOL M ™ solvent (mL) | — | — | — | — | — | — |
| MEK (mL) | 5 | — | 7.5 | 7.5 | 8.5 | 7.5 |
| Ethanol (mL) | 5 | — | — | — | — | — |
| Hexanol (mL) | — | — | — | — | — | — |
| Demulsifier | — | — | — | 4 drops | 4 drops | 4 drops |
| Total (mL) | 100 | 100 | 100 | 100 | — | 100 |
| Aq phase (mL) | 75 | 60 | 73 | 71 | — | 73 |
| Non-aq phase minus pentane (mL) | 0 | 7 | 2 | 4 | — | −1 |

The water transfer system may act as an energized medium transfer downhole. The LPG component is the medium that is transferred out of the system, while water is the medium transferred into the system. As water is absorbed into the water transfer system, the polarity of the entire system changes to displace the LPG from the solvent /water mixture. In this way, the LPG starts off as the carrier fluid and ends up as a separate phase that then aids in the transport of the water/solvent phase. The displaced LPG assists in the transport of the system by providing gas energy (lift) as the carrier/energizer to the system to enhance the flow of the solvent water system from the reservoir 28. The water transfer system may not contain CO2.

Figure 5:
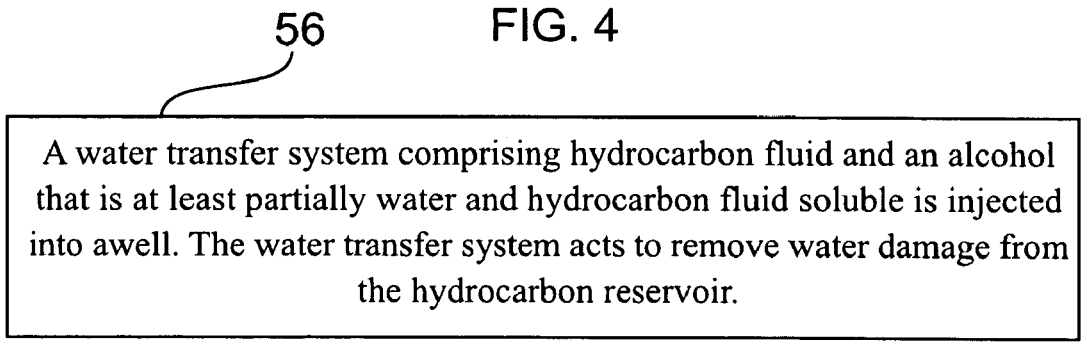
FIG. 5 is a flow schematic illustrating a method of treating a hydrocarbon reservoir that is penetrated by a well, the hydrocarbon reservoir comprising water damage.

Referring to FIG. 5, a further method is illustrated. Referring to FIG. 1, the method of FIG. 5 is a method of treating hydrocarbon reservoir 28 that is penetrated by well 26 is also disclosed, the hydrocarbon reservoir 28 comprising water damage. In a first stage (shown in FIG. 5), a water transfer system comprising hydrocarbon fluid and an alcohol that is at least partially water and hydrocarbon fluid soluble is injected into the well 26, for example from source 10. The water transfer system acts to remove water damage from the hydrocarbon reservoir 28. In one embodiment, the hydrocarbon fluid comprises liquefied petroleum gas. This method is understood to include all the embodiments disclosed herein in this document. The hydrocarbon fluid transfers from the water transfer system upon contact with water in the formation, and the transferred water forms a solution with the remaining components of the water transfer system that can be removed from the formation.

The use of a water transfer system may be contrasted with a displacement fluid used in secondary recovery, in that the water transfer system repairs and removes water from a damaged formation around a production well, while the displacement fluid effectively introduces water and damage into the formation around the injection well. The displacement fluid also eventually damages the production well it is intended to stimulate. In some embodiments, the water transfer system is used to repair water damage from a production well previously treated by secondary recovery processes.

As disclosed above, SYNSOL M™ solvent may be used in the water transfer system. SYNSOL M™ solvent is a solvent system that may be used in the acidizing and cleanup of oil wells and gas wells. The solvent system may comprise a combination of a substantially water-soluble alcohol, such as methanol, ethanol or any mixture thereof, a substantially water / oil-soluble ester, such as one or more $C_2$ - $C_{10}$ esters, and a substantially water / oil-soluble solvent that is either a ketone or cyclic ether, for example a ketone, such as one or more $C_2$ - $C_{10}$ ketones. An aqueous acid may also be present. The solvent may be present in an amount from 5 wt % to about 50 wt %, the substantially water soluble alcohol may be present in an amount within the range of about 5 wt % to about 50 wt %, and the substantially water/ oil-soluble ester may be present in an amount within the range of about 5 wt % to about 50 wt %, each amount being based upon the volume of the SYNSOL M™ solvent. The aqueous acid may be present in any suitable amount for the intended application.

In the claims, the word "comprising" is used in its inclusive sense and does not exclude other elements being present. The indefinite article "a" before a claim feature does not exclude more than one of the feature being present. Each one of the individual features described here may be used in one or more embodiments and is not, by virtue only of being described here, to be construed as essential to all embodiments as defined by the claims.

The embodiments of the invention in which an exclusive property or privilege is claimed are defined as follows:

1. A method of treating a water-damaged hydrocarbon reservoir that is penetrated by a well, the method comprising injecting into the well a water transfer system that is non-aqueous and comprises liquefied petroleum gas and a solvent system that is at least partially water and liquefied petroleum gas soluble, the solvent system consisting essentially of C1-C8 solvent components and comprising an alcohol that is at least partially water and liquefied petroleum gas soluble.

2. The method of claim 1 in which the water-damaged hydrocarbon reservoir comprises a reservoir that was previously treated with a water-based fracturing fluid comprising CO2.

3. The method of claim 1 in which the alcohol is present in an amount of 1%-60% by weight of the water transfer system.

4. The method of claim 1 in which the alcohol is present in an amount of 1%-30% by volume of the water transfer system.

5. The method of claim 1 in which the alcohol has between 1 and 4 carbon atoms.

6. The method of claim 1 in which the water transfer system further comprises an ester that is at least partially water and liquefied petroleum gas soluble.

7. The method of claim 6 in which the ester is present in an amount of at least 1% by volume of the water transfer system.

8. The method of claim 6 in which the ester is present in an amount of at most 30% by volume of the water transfer system.

9. The method of claim 6 in which the alcohol and the ester are part of the same molecule.

10. The method of claim 1 in which the ester has between 3 and 6 carbon atoms.

11. The method of claim 1 in which the water transfer system further comprises an ether that is at least partially water and liquefied petroleum gas soluble.

12. The method of claim 11 in which the ether is present in an amount of at least 1% by volume of the water transfer system.

13. The method of claim 11 in which the ether is present in an amount of at most 30% by volume of the water transfer system.

14. The method of claim 11 in which the alcohol and the ether are part of the same molecule.

15. The method of claim 1 in which the ether has between 3 and 6 carbon atoms.

16. The method of claim 1 in which the water transfer system further comprises a ketone that is at least partially water and liquefied petroleum gas soluble.

17. The method of claim 16 in which the ketone is present in an amount of at least 1% by volume of the water transfer system.

18. The method of claim 16 in which the ketone is present in an amount of at most 30% by volume of the water transfer system.

19. The method of claim 16 in which the alcohol and the ketone are part of the same molecule.

20. The method of claim 1 in which the ketone has between 3 and 6 carbon atoms.

21. The method of claim 1 in which the water transfer system further comprises a demulsifier.

22. The method of claim 21 in which the demulsifier is present in an amount of at least 1% by volume of the water transfer system.

23. The method of claim 1 in which the liquefied petroleum gas is present in an amount of between 40% and 60% by volume of the water transfer system.

24. The method of claim 1 in which the alcohol comprises isopropyl alcohol.

25. A method of treating a water-damaged hydrocarbon reservoir comprising introducing into the hydrocarbon reservoir a combination that is non-aqueous and comprises liquefied petroleum gas and a solvent system that is at least partially liquefied petroleum gas and water soluble, the solvent system consisting essentially of C1-C8 solvent components and comprising an alcohol that is at least partially water and liquefied petroleum gas soluble.

26. The method of claim 25 further comprising subjecting the combination to pressures above the formation pressure.

27. The method of claim 26 in which the combination is subjected to pressures at or above fracturing pressures.

28. The method of claim 25 in which the solvent system further comprises an ether.

29. The method of claim 25 in which the solvent system further comprises an ester.

30. The method of claim 25 in which the solvent system further comprises a ketone.

31. The method of claim 25 in which the solvent system further comprises a demulsifier.

32. The method of claim 25 in which the solvent system is a mutual solvent system.

33. The method of claim 25 in which the alcohol comprises isopropyl alcohol.

34. A method of treating a hydrocarbon reservoir that is penetrated by a well, the hydrocarbon reservoir comprising water damage, the method comprising:

injecting into the well a water transfer system that is non-aqueous and comprises liquefied petroleum gas hydrocarbon fluid and a solvent system that is at least partially water and hydrocarbon fluid soluble, the solvent system consisting essentially of C1-C8 solvent components and comprising an alcohol that is at least partially water and liquefied petroleum gas soluble;

in which the water transfer system acts to remove water damage from the hydrocarbon reservoir.

35. The method of claim 34 in which the alcohol comprises isopropyl alcohol.

* * * * *